US007010827B2

(12) United States Patent
Kim

(10) Patent No.: US 7,010,827 B2
(45) Date of Patent: Mar. 14, 2006

(54) BRUSH FOR MASSAGING HEAD SKIN

(76) Inventor: Yon Chol Kim, 279-67 Suyu 2-Dong, Kangbuk-Gu, Seoul 142-879 (KR)

( * ) Notice: Subject to any disclaimer, the term of this patent is extended or adjusted under 35 U.S.C. 154(b) by 14 days.

(21) Appl. No.: 10/406,718

(22) Filed: Apr. 2, 2003

(65) Prior Publication Data

US 2004/0068816 A1 Apr. 15, 2004

(30) Foreign Application Priority Data

Oct. 14, 2002 (KR) ..... 20-2002-0030598

(51) Int. Cl.
*A45D 24/16* (2006.01)
*A46B 7/00* (2006.01)

(52) U.S. Cl. ..... 15/186; 132/120

(58) Field of Classification Search ..... 15/186–188, 15/201, 205.2; 601/136–137; 132/120; D4/127

See application file for complete search history.

(56) References Cited

U.S. PATENT DOCUMENTS 233,508 A * 10/1880 Hill et al. ..... 15/186
758,109 A * 4/1904 Sandiford ..... 15/167.1
3,651,532 A * 3/1972 Wettburg ..... 15/186
3,766,590 A * 10/1973 Wachtel ..... 15/186
4,030,158 A * 6/1977 Blair et al. ..... 15/207.2
5,095,892 A * 3/1992 Tsumura ..... 601/137

* cited by examiner

*Primary Examiner*—John Kim
*Assistant Examiner*—Laura C Cole
(74) *Attorney, Agent, or Firm*—Anderson Kill & Olick, PC

(57) ABSTRACT

A brush for massaging head skin including a body portion having an annular bristle mounting part at one side, and a handle at the other side, an annular bristle fixing part fixed on the bristle mounting part, and a plurality of bristles fixed on the bristle fixing part. Since the bristle mounting part of the body is annular-shaped and the supporting part and the bristle fixing part which are fixedly mounted on the bristle mounting part are annular-shaped, respectively, almost all bristles are brought into contact with a curved portion of the head, thereby increasing a contact efficiency between the bristles and the head skin. Therefore, the head skin can be effectively stimulated, thereby preventing alopecia and simultaneously promoting hair growth.

5 Claims, 6 Drawing Sheets

BRUSH FOR MASSAGING HEAD SKIN

BACKGROUND OF THE INVENTION

1. Field of the Invention

The present invention relates to brush for massaging head skin, and more particularly, to brush for massaging head skin, designed to allow bristles to contact head skin as widely as possible for effectively massaging head skin and activating tissues of head skin, thereby preventing hair loss and stimulating hair growth.

2. Description of the Related Art

Alopecia is a condition in which hair growth stops at a head skin portion and hairs fall off from the head skin due to malfunction of skin tissues. Alopecia has recently become severer, and various kinds of diseases, stress, abuse of therapeutic drugs or shampoo, and environmental pollution as well as hereditary factors are often given as reasons for the alopecia.

Alopecia is caused due to shrinkage of hair follicle by poor blood circulation, resulting from capillary contraction.

Although hair transplant surgery is used as a measure to solve the problem of alopecia, it is costly and requires a long period of treatment. For stimulation of hair growth, there have been used hair growth promoters or ingestible medications, which are, however, only partially effective in continuously preventing alopecia and in promoting hair growth.

Brushes have been used for prevention of alopeica and promotion of hair growth, however, conventional brushes mostly have a rectangular or elliptic body part, and are generally configured such that teeth of the brushes are fixedly inserted into fixing holes. The basic principle of the conventional brushes is to stimulate head skin and activate hair root such that the hair is brushed as many times as possible, thereby preventing alopecia and promoting hair growth.

However, the conventional brush is flat, only some of brush teeth contact the head skin at a curved portion of the head, e.g., the vertex. Thus, the efficiency of a contact between the head skin and brush teeth (bristles) is low, deteriorating a massaging effect for stimulating head skin.

SUMMARY OF THE INVENTION

To solve the above-described problems, it is an object of the present invention to provide a brush for massaging head skin, which can increase a contact efficiency between head skin and brush teeth, so that progress of alopecia can be prevented by activating circulation of hair follicle cells of head skin and growth of hair roots on a portion of head skin afflicted with alopecia can be promoted.

In an aspect of the present invention, there is provided a brush for massaging head skin, comprising a body portion having an annular bristle mounting part at one side, and a handle at the other side; an annular bristle fixing part fixed on the bristle mounting part; and a plurality of bristles fixed on the bristle fixing part.

BRIEF DESCRIPTION OF THE DRAWINGS

The above objects and advantages of the present invention will become more apparent by describing preferred embodiments in detail with reference to the attached drawings in which.

DETAILED DESCRIPTION OF THE INVENTION

Figure 1:
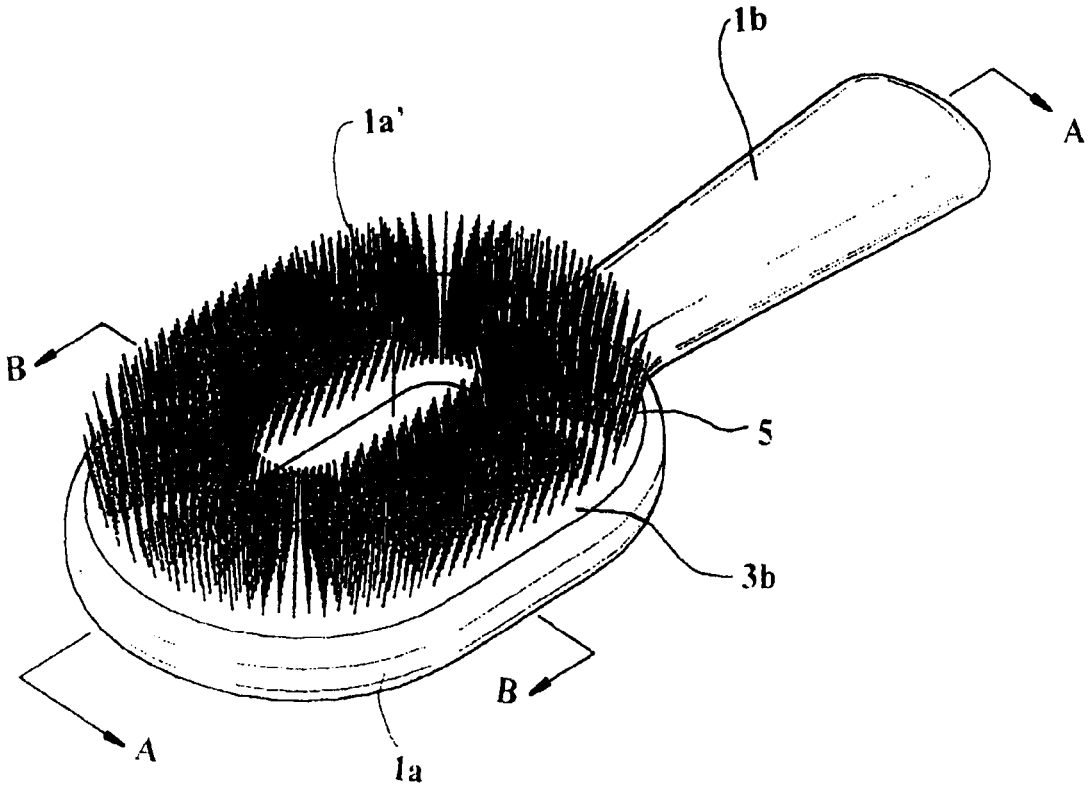
FIG. 1 is a perspective view of a brush for massaging head skin according to the present invention.
Figure 2:
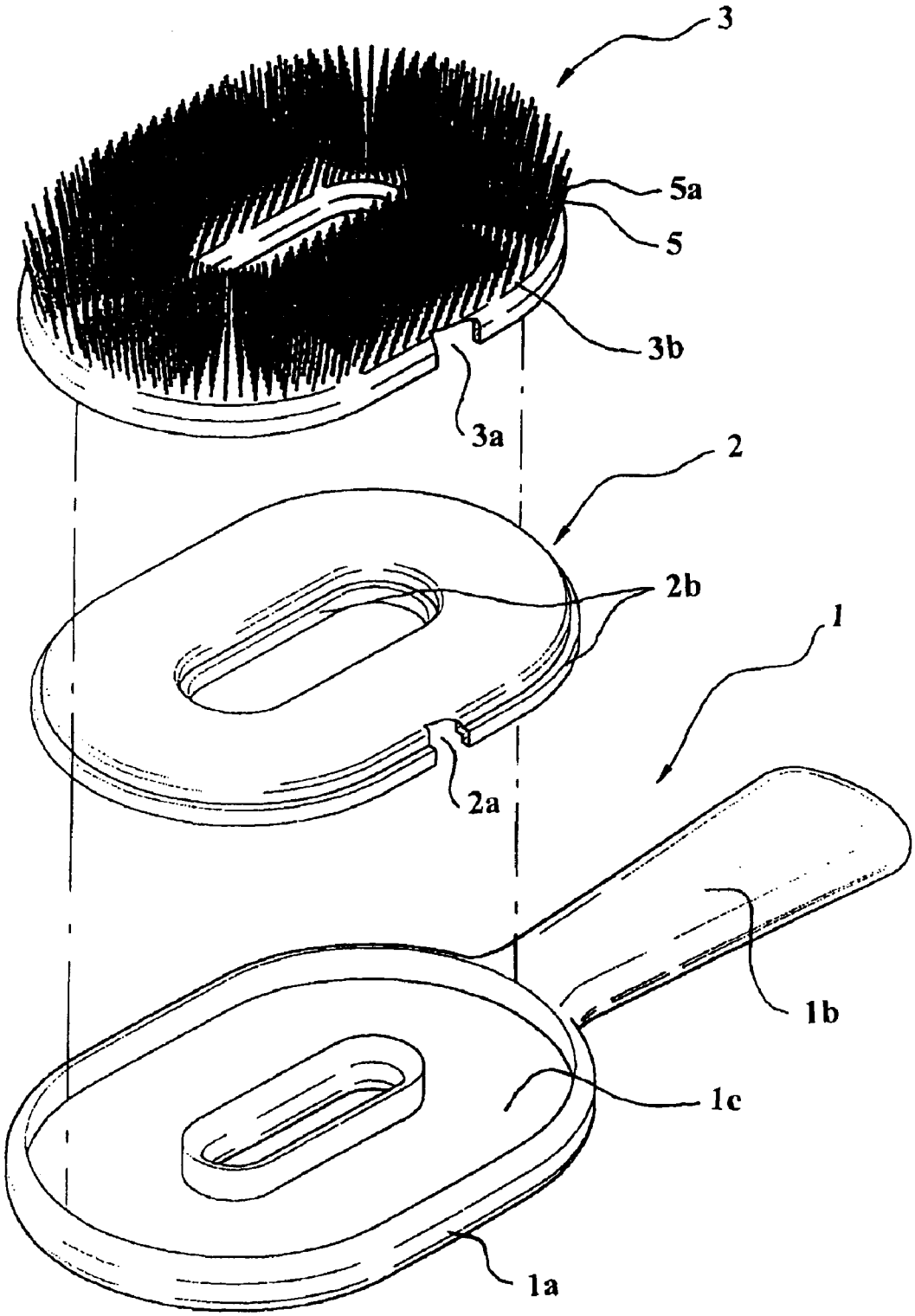
FIG. 2 is a partially exploded perspective view of the brush shown in FIG. 1.
Figure 3:
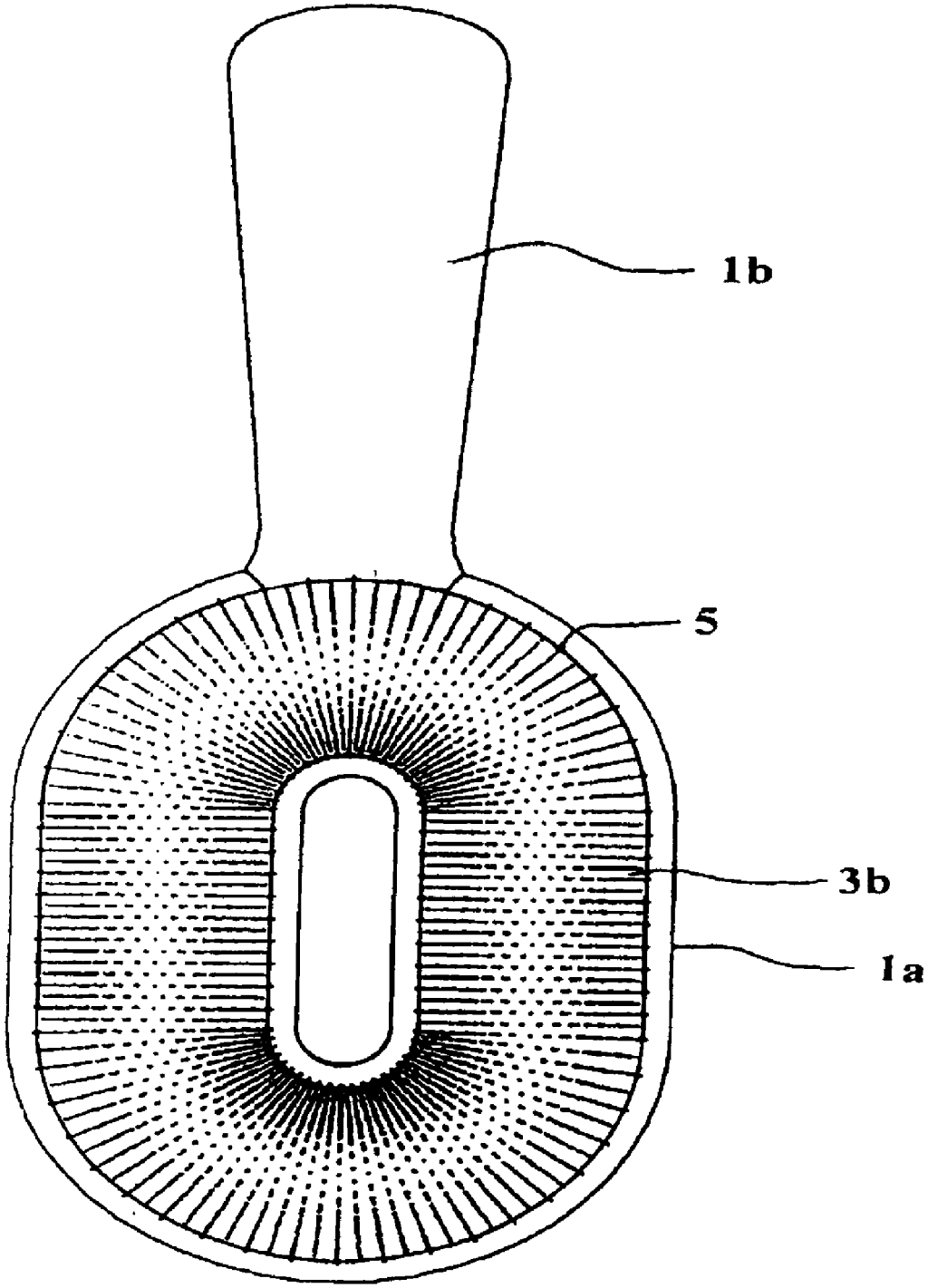
FIG. 3 is a plan view of the brush shown in FIG. 1.
Figure 4:
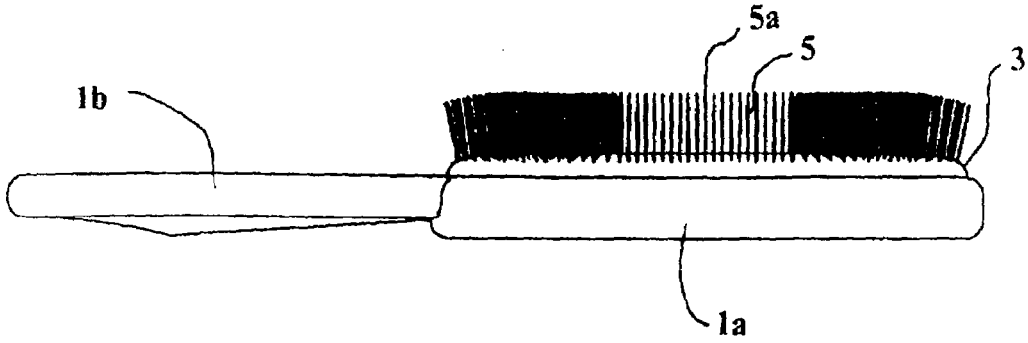
FIG. 4 is a left side view of the brush shown in FIG. 1.
Figure 5:
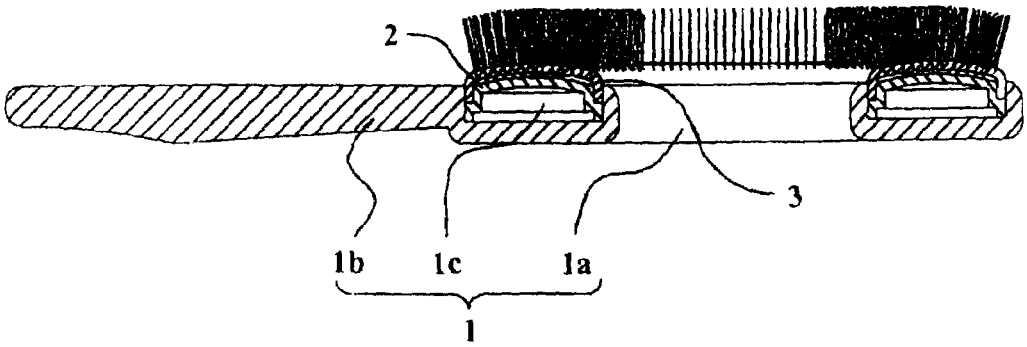
FIG. 5 is a cross-sectional view taken along the line shown in FIG. 1.
Figure 6:
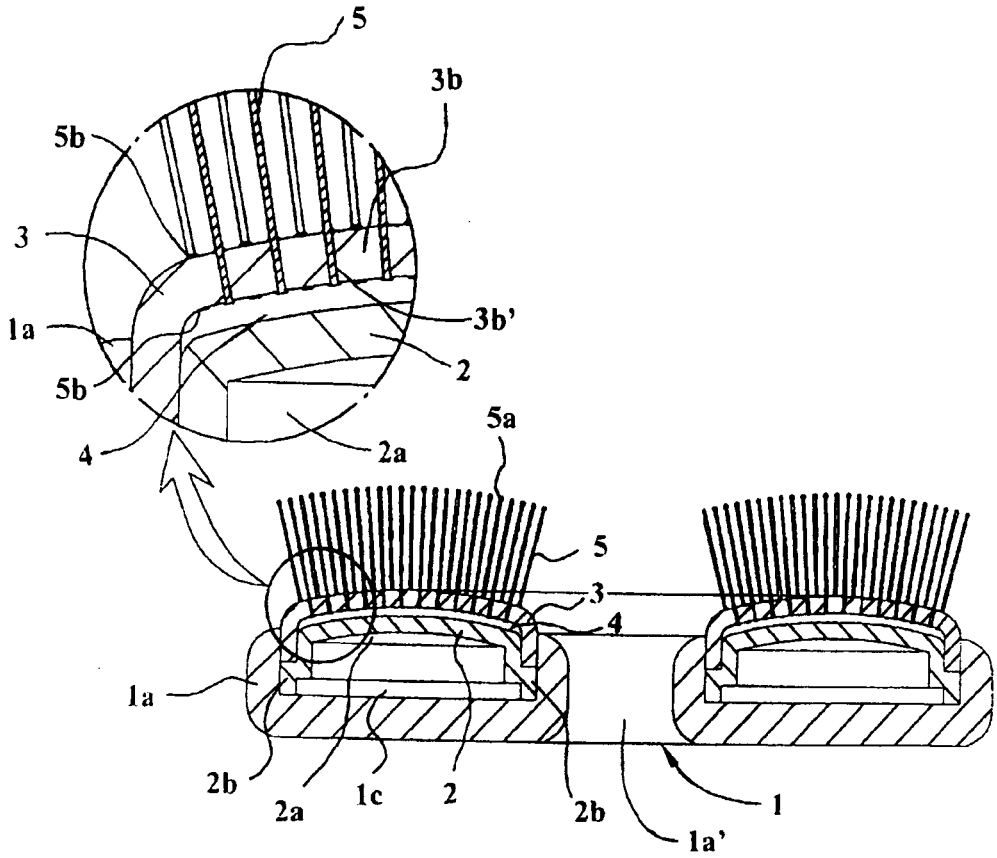
FIG. 6 is a partially enlarged, cross-sectional view taken along the line shown in FIG. 1.
Figure 7:
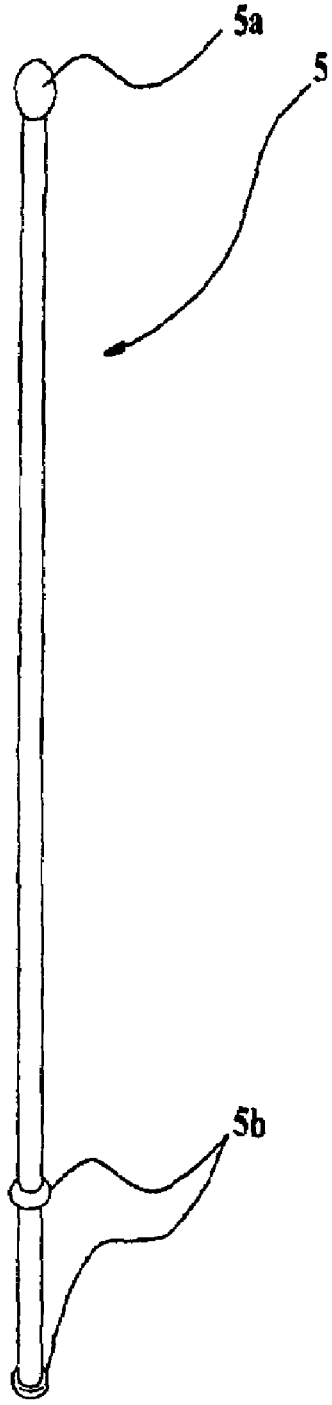
FIG. 7 is a schematic diagram of a bristle.

A brush for massaging head skin according to the present invention, as shown in FIGS. 1 through 7, includes a body 1 having an annular bristle mounting part 1*a* at one side, and a handle 1*b* at the other side.

An annular bristle fixing part 3 is fixed on the bristle mounting part 1*a*, and a plurality of bristles 5 are fixed on the bristle fixing part 3. The bristle fixing part has a reversed U-shaped cross-section.

The bristle mounting part 1*a* of the body 1 is provided with an annular recess 1*c* such that an annular supporting part 2 for supporting the bristle fixing part 3 and the annular bristle fixing part 3 thereon are fixedly seated.

The bristle supporting part 2 includes an internal space 2*a* so as to be shaped in an annular, upward convex form. Also, the bristle supporting part 2 includes a flange 2*b* along the lower edge of the bristle supporting part 2, the flange 2*b* fixed in contact with the bristle mounting part 1*a* of the body 1 and supporting the lower edge of the bristle fixing part 3.

The bristle fixing part 3 includes an internal space 3*a* so as to be shaped in an annular, upward convex form. The lower edge of the bristle fixing part 3 is interposed and fixed between the bristle mounting part 1*a* of the body 1 and the supporting part 2 in contact with the top surface of the flange 2*b* of the supporting part 2.

The bristle supporting part 2 is disposed under the bristle fixing part 3 in such a manner that it supports the bristle fixing part 3, with a gap 4 between the bristle supporting part 2 and the bristle fixing part 3. In the bristle fixing part 3, a plurality of fixing holes 3*b*' are formed in an annular, convex bristle fixing plane 3*b* at a constant gap so that the bristles 5 are fixedly inserted thereinto.

Each bristle 5 has a spherical contact part 5*a* at its upper end, and projecting parts 5*b* at its lower end so that the bristle 5 can be fixed after being perforated into each of the fixing holes 3*b*' formed in the bristle fixing plane 3*b*. Undefined reference numeral 1*a*' denotes a hollow portion of the annular bristle mounting part 1*a*.

The aforementioned brush for massaging head skin according to the present invention can be used to brush hair in the same manner as a conventional brush. Then, the plurality of bristles 5 installed in the bristle fixing part 3 stimulate and massage the head skin, thereby promoting blood circulation of the head skin.

According to the present invention, since the body 1, the supporting part 2 and the bristle fixing part 3 are annular-shaped with densely disposed bristles, the bristles 5 contact and massage the head skin all-roundly. Thus, irrespective of whether a portion of the head skin is curved, e.g., like the vertex, or not, most of the bristles 5 installed in the bristle fixing part 3 occupy a wide area of the head skin while evenly contacting the head skin. Thus, the brush for massaging head skin according to the present invention can massage and stimulate the head skin with a noticeably high contact efficiency between the brush and the head skin, compared to the conventional brush, thereby preventing alopecia and promoting hair growth.

The brush for massaging head skin according to the present invention preferably, but not necessarily, has approximately 220 bristles in the bristle fixing part 3. Also, the bristles are preferably formed of a metal or plastic material and the bristle fixing part 3 are preferably formed of rubber.

In order to investigate the efficacy of the brush for massaging head skin according to the present invention, the hair of an adult afflicted with alopecia was brushed 30 minutes a day for 4 months. As a result, the progress of alopecia came to a stop and the normal hair not yet afflicted with alopecia became resilient and glossy. Also, the result showed that the remaining hair that is thin, short and weak due to impeded growth even though it is not afflicted with alopecia, started to grow and became noticeably thick and long. When the hair afflicted with alopecia was brushed for one year with the brush according to the present invention, even missing hair due to alopecia was replaced by fine-colored, normally grown hair, confirming that approximately 60% of a full head hair was restored As described above, according to the present invention, since the bristle mounting part 1*a* of the body 1 is annular-shaped and the supporting part 2 and the bristle fixing part 3 which are fixedly mounted on the bristle mounting part 1*a* are annular-shaped, respectively, almost all bristles 5 are brought into contact with a curved portion of the head, thereby increasing a contact efficiency between the bristles 5 and the head skin. Use of the brush according to the present invention allows head skin to be effectively stimulated to promote blood circulation in head skin tissues, thereby preventing alopecia and simultaneously promoting hair growth newly from hair follicle.

What is claimed is:

1. A brush for massaging head skin comprising:

a body portion having an annular bristle mounting part at one side, and a handle at another side with the annular bristle mounting part having a first outer rim for forming an annular recess and having a middle part centrally located with a second outer rim in said body portion separated from the first outer rim with a single hollow portion extending through said body portion for forming an elongated geometry;

an annular bristle fixing part fixed on the bristle mounting part in said annular recess between said first outer rim and said second outer rim and having a hollow portion aligned with the hollow portion of said annular bristle mounting part; and a plurality of bristles annularly fixed on the annular bristle fixing part in an arrangement surrounding the hollow portion of each of said annular bristle fixing part and mounting part respectively.

2. The brush of claim 1, wherein an annular recess on which the annular bristle fixing part is fixedly seated, is formed on the bristle mounting part of the body.

3. The brush of claim 1, wherein a bristle supporting part for supporting the bristle fixing part is disposed between the bristle mounting part of the body and the bristle fixing part.

4. The brush of claim 3, wherein the bristle supporting part supports the bristle fixing part, the edge of the bristle fixing part is fixedly disposed between the bristle supporting part and the bristle mounting part, and a flange is formed along the lower edge of the bristle supporting part, wherein the lower edge of the bristle fixing part is seated on the flange.

5. The brush of claim 1, wherein the bristle fixing part has a reversed U-shaped cross-section.

* * * * *